US008894511B2

(12) United States Patent
Lore et al.

(10) Patent No.: US 8,894,511 B2
(45) Date of Patent: Nov. 25, 2014

(54) FOLDING SPORT NET WITH BALL RETURN SYSTEM

(71) Applicants: Renan Lore, Vannes (FR); Huaimian Zhang, Fuzhou (CN)

(72) Inventors: Renan Lore, Vannes (FR); Huaimian Zhang, Fuzhou (CN)

( * ) Notice: Subject to any disclaimer, the term of this patent is extended or adjusted under 35 U.S.C. 154(b) by 138 days.

(21) Appl. No.: 13/854,315

(22) Filed: Apr. 1, 2013

(65) Prior Publication Data

US 2013/0260925 A1 Oct. 3, 2013

Related U.S. Application Data

(60) Provisional application No. 61/219,295, filed on Apr. 2, 2012.

(51) Int. Cl.

| | |
|---|---|
| ***A63B 69/00*** | (2006.01) |
| ***A63B 63/00*** | (2006.01) |
| *A63B 69/36* | (2006.01) |

(52) U.S. Cl.

CPC ..... *A63B 63/00* (2013.01); *A63B 69/3623* (2013.01); *A63B 2063/001* (2013.01); *A63B 2210/50* (2013.01)

USPC ..... 473/431; 473/197; 273/400; 273/394

(58) Field of Classification Search

CPC ..... A63B 71/022; A63B 2210/50; A63B 2210/54; A63B 63/00; A63B 63/004; A63B 63/007; A63B 2208/12; A63B 69/3623; A63B 2063/00; A63B 2063/001; A63B 2063/002; A63B 2063/004; A63B 2063/005; A63B 2069/0006; A63B 67/002; E04H 15/36; E04H 15/40; E04H 15/42; E04H 15/44; E04H 15/54; E04H 15/56; E04H 15/425; E04H 15/58

USPC ..... 273/398–402, 395, 396, 394; 473/476, 473/478, 434, 435, 197, 454, 431; 135/125, 135/126, 133–136, 138

See application file for complete search history.

(56) References Cited

U.S. PATENT DOCUMENTS

| | | | | | |
|---|---|---|---|---|---|
| 3,990,463 | A * | 11/1976 | Norman | ..... | 135/126 |
| 4,127,267 | A | 11/1978 | Bay et al. | | |
| 4,491,141 | A * | 1/1985 | Eppenbach | ..... | 135/125 |
| 5,088,740 | A * | 2/1992 | Peterson | ..... | 273/410 |
| 5,178,384 | A | 1/1993 | Gorman | | |
| 5,370,145 | A * | 12/1994 | Wu | ..... | 135/127 |
| 5,427,381 | A * | 6/1995 | Macaluso et al. | ..... | 273/400 |
| 5,823,885 | A | 10/1998 | Stempfer | | |
| 5,863,265 | A * | 1/1999 | Acton | ..... | 473/470 |
| 5,941,529 | A * | 8/1999 | Kinsey | ..... | 273/401 |
| 5,989,130 | A * | 11/1999 | Macaluso | ..... | 473/197 |
| 6,319,145 | B1 * | 11/2001 | Coughlan | ..... | 473/197 |
| 6,352,480 | B1 * | 3/2002 | Macaluso | ..... | 473/197 |

(Continued)

*Primary Examiner* — Mark Graham

(74) *Attorney, Agent, or Firm* — Steven A. Nielsen; Allman & Nielsen, P.C.

(57) ABSTRACT

A portable and easily foldable sport net 50 includes a ball return system wherein balls 930 or other projectiles are stopped and gently rolled back to the user. A frame system 200 may include spring steel or fiberglass and may further includes front frame members 210, rear frame members 220 and lower lateral frame members 230. An inside net 100 is attached or integrated into the front frame members 210 and the inside net 100 has little contact or attachment to the rear frame members 220. The judicious use of netting material and other components result in a lightweight and easy to assemble sport net. Embodiments feature two lateral voids 250 and a rear void 240 which provide an economy of construction and efficiency of use.

11 Claims, 14 Drawing Sheets

(56) References Cited

U.S. PATENT DOCUMENTS

| | | | | |
|---|---|---|---|---|
| 6,514,149 | B2 * | 2/2003 | Yoon | 473/197 |
| 6,517,444 | B1 * | 2/2003 | Yoon | 473/197 |
| 6,579,196 | B1 | 6/2003 | Yoon | |
| 6,793,594 | B1 * | 9/2004 | Grant | 473/476 |
| 6,857,460 | B1 * | 2/2005 | Mowry | 160/351 |
| 6,991,567 | B2 * | 1/2006 | Wong et al. | 473/478 |
| 7,118,487 | B2 * | 10/2006 | Turcot | 473/197 |
| 7,198,274 | B2 * | 4/2007 | Cho | 273/400 |
| 7,252,603 | B2 | 8/2007 | Bove et al. | |
| 7,270,608 | B2 * | 9/2007 | Cho | 473/197 |
| 7,651,098 | B2 * | 1/2010 | Cho | 273/400 |
| 7,731,198 | B2 * | 6/2010 | Cho | 273/396 |
| 8,403,330 | B2 * | 3/2013 | Cho | 273/400 |
| 2002/0058556 | A1 * | 5/2002 | Zheng | 473/471 |
| 2002/0119842 | A1 * | 8/2002 | Vermeulen | 473/476 |
| 2003/0203775 | A1 * | 10/2003 | Wong | 473/478 |
| 2003/0224866 | A1 * | 12/2003 | Chen | 473/197 |
| 2005/0176518 | A1 * | 8/2005 | Doherty et al. | 473/197 |
| 2006/0073919 | A1 * | 4/2006 | Morrow | 473/434 |
| 2006/0273521 | A1 | 12/2006 | Nash | |
| 2007/0062570 | A1 * | 3/2007 | Zheng | 135/126 |
| 2008/0032827 | A1 * | 2/2008 | Behrend | 473/446 |
| 2009/0096171 | A1 * | 4/2009 | Simon | 273/400 |
| 2011/0015002 | A1 | 1/2011 | Brown | |
| 2011/0297200 | A1 * | 12/2011 | Price et al. | 135/126 |
| 2013/0045815 | A1 * | 2/2013 | Cho | 473/197 |
| 2013/0130818 | A1 * | 5/2013 | Peck | 473/197 |
| 2014/0051532 | A1 * | 2/2014 | Munro | 473/478 |

* cited by examiner

Fig. 11 A-L

FOLDING SPORT NET WITH BALL RETURN SYSTEM

CROSS-REFERENCE TO RELATED APPLICATIONS

This is a utility application based upon U.S. patent application Ser. No. 61/619,295 filed on Apr. 2, 2012. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to folding sport nets. More particularly, the invention relates to means and methods of creating a folding sport net having ball return systems.

(2) Description of the Related Art

Other folding sport nets are known in the related art, but all lack the inventive attributes of the present invention.

For example, the following patents or published patent applications disclose ball nets having bulky frame members not well suited for easy transport or toolless assembly:

U.S. Pat. No. 5,823,855 by Stempfer, granted on Oct. 20, 1998; U.S. Pat. No. 4,125,267 by Bay et al, granted on Nov. 28, 1978; U.S. Pat. No. 5,178,384 by Gorman, granted on Jan. 12, 1993; U.S. Pa. No. 6,319,145 by Coughlan, granted on Nov. 20, 2001; U.S. Pat. No. 6,579,196 by Yoon, granted on Jun. 17, 2003; U.S. Pat. No. 7,252,603 by Bove et al, granted on Aug. 7, 2007; U.S. Patent Application 2006/0273521 by Nash, published on Dec. 7, 2006; U.S. Patent Application 2011/0015002 by Brown, published on Jan. 20, 2011.

BRIEF SUMMARY OF THE INVENTION

Disclosed embodiments overcome shortfalls in the related art by presenting an unobvious and unique combination and configuration of methods and components to create a portable, collapsible sport net that may be assembled and disassembled without tools or complicated instructions. Unlike the related art, the present invention does not use stiff frame or tent poles that require assembly.

Disclosed embodiments overcome shortfalls in the art by providing a new automatic ball return system via the artful use of an inside net or front net integrated into a front frame member, front and back lateral elastic nets, lower lateral support panels, rear frame members devoid of netting, elastic cords attached to the upper rear portions of the net and rear frame members, upper lateral stabilizer cords and other components. The presently disclosed embodiments provide an automatic ball return system using less components as compared to the prior art systems.

The automatic ball return system uses the kinetic or stored energy absorbed by a projectile to propel the projectile back to the user of the system. The artful use of elastic and non-elastic cords, elastic front and rear lateral stabilizer nets, a steel spring frame system or fiberglass frame system and other components assist in the graceful damping of balls striking the system and gentle return of balls striking the system.

These and other objects and advantages will be made apparent when considering the following detailed specification when taken in conjunction with the drawings.

REFERENCE NUMERALS IN THE DRAWINGS

50 a disclosed system in general

100 inside net

Figure 1:
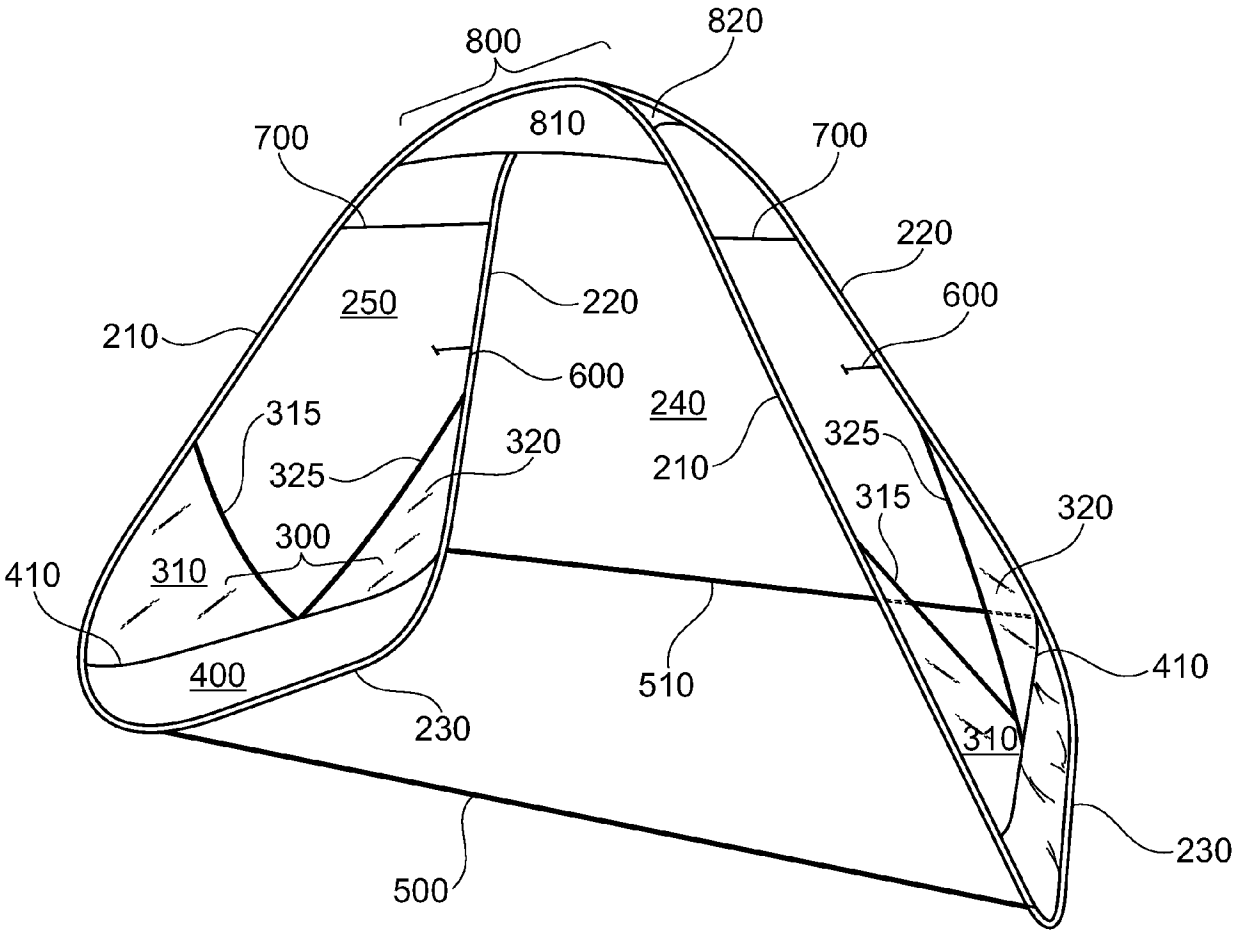
FIG. 1 depicts a front perspective view of a disclosed system without an inside net

110 lateral edges of inside net attached or integrated into front frame members 210

120 upper rear portions of inside net 100

130 lower edge of inside net 100

200 frame system

210 front frame members

220 rear frame members

230 lower lateral frame members attached or integrated with front frame members and rear frame members

240 rear void of frame system defined by rear frame members 220, rear stabilizer cord 510, and rear member 830 of top canopy system

250 lateral void of frame system defined by front frame member 210, rear frame member 220, stabilizer cord 315 of top portion of elastic front frame stabilizer net and stabilizer cord 325 of top portion of elastic back frame stabilizer net and upper lateral stabilizer cord 700

270 apex of frame system, found where the front and rear frame members attach adjacent to the top canopy system 800

300 lateral elastic net system

310 elastic front lateral stabilizer net

311 alternative embodiment of front lateral stabilizer net

315 stabilizer cord of top portion of elastic front lateral stabilizer net 310

316 stabilizer cord of top portion of alternative embodiment of front lateral stabilizer net 311

320 elastic rear lateral stabilizer net

321 alternative embodiment of rear lateral stabilizer net

325 stabilizer cord of top portion of elastic rear lateral stabilizer net 320

326 stabilizer cord of top portion of alternative embodiment of rear lateral stabilizer net 321

327 cord or seam attaching front and rear lateral stabilizer nets of alternative embodiment

400 lower lateral support panel

410 lateral stabilizer cord, attached to upper side of lower lateral support panel 400 and lower ends of front and rear elastic lateral stabilizer nets 310, 320

500 front stabilizer cord attached to lower portions of front frame members 210

510 rear stabilizer cord attached to lower portions of rear frame members 220

530 upper rear stabilizer cord attached to top portions of the rear frame members 220 near apex

600 elastic cord from rear frame member 220 to upper rear portions 120 of inside net 100

700 upper lateral stabilizer cord attached to front frame member 210 and rear frame member 220

800 top canopy system

810 front member of top canopy system

820 lateral member of top canopy system

830 rear member of top canopy system

900 lateral elastic net system 300 in a neutral position prior to a ball 930 striking the system

910 inward deformation of a lateral elastic net system 300 upon a ball striking the system

920 outward deformation or release of kinetic energy of a lateral elastic net system 300 returning a ball

930 projectile such as a golf ball or other ball or object

1000 sport net of the prior art

1010 floor system of a prior art sport net

1020 full lateral net system of a prior art sport net

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines FIG. 1 depicts a disclosed system without an inside net to aid in clarity of illustration. A frame system 200 comprises front frame members 210, rear frame members 220 and lower lateral frame members 230. A front stabilizer cord 500 may be in attachment to lower lateral frame members. The front stabilizer cord 500 shown in a front position of the system.

Toward the rear of the system, a rear stabilizer cord 510 is shown in attachment to rear frame members 220 and/or lateral stabilizer cords 410. Lateral stabilizer cords 410 are shown in attachment to lower lateral support panels 400 on either side of the system. The lateral stabilizer cords 410 are shown in attachment to the lower portions of the elastic front lateral stabilizer net 310 and the elastic rear lateral stabilizer net 320.

The lateral elastic net system 300 assists in ball return functions and comprise an elastic front lateral stabilizer net 310, an elastic rear lateral stabilizer net 320, stabilizer cords 315 and 325 attached to the top portions of the front and rear elastic lateral stabilizer nets, the lateral stabilizer cord 410 and the lower lateral support panel. The physics and functions of the lateral elastic net system are shown in more detail in FIGS. 8-10.

FIG. 1 further depicts elastic cords 600 attached to the rear frame members 220 to the back side of the inside net (not shown). The use of such elastic cords assists in ball return, ease of assembly, damping of impact, economy of construction and other advantages.

FIG. 1 further depicts static upper lateral stabilizer cords 700 which span between the front frame members 210 and the rear frame members 220. The upper lateral stabilizer cords 700 assist in holding the system in place, ease of assembly, add rigidity, assist in ball return and other functions.

Figure 7:
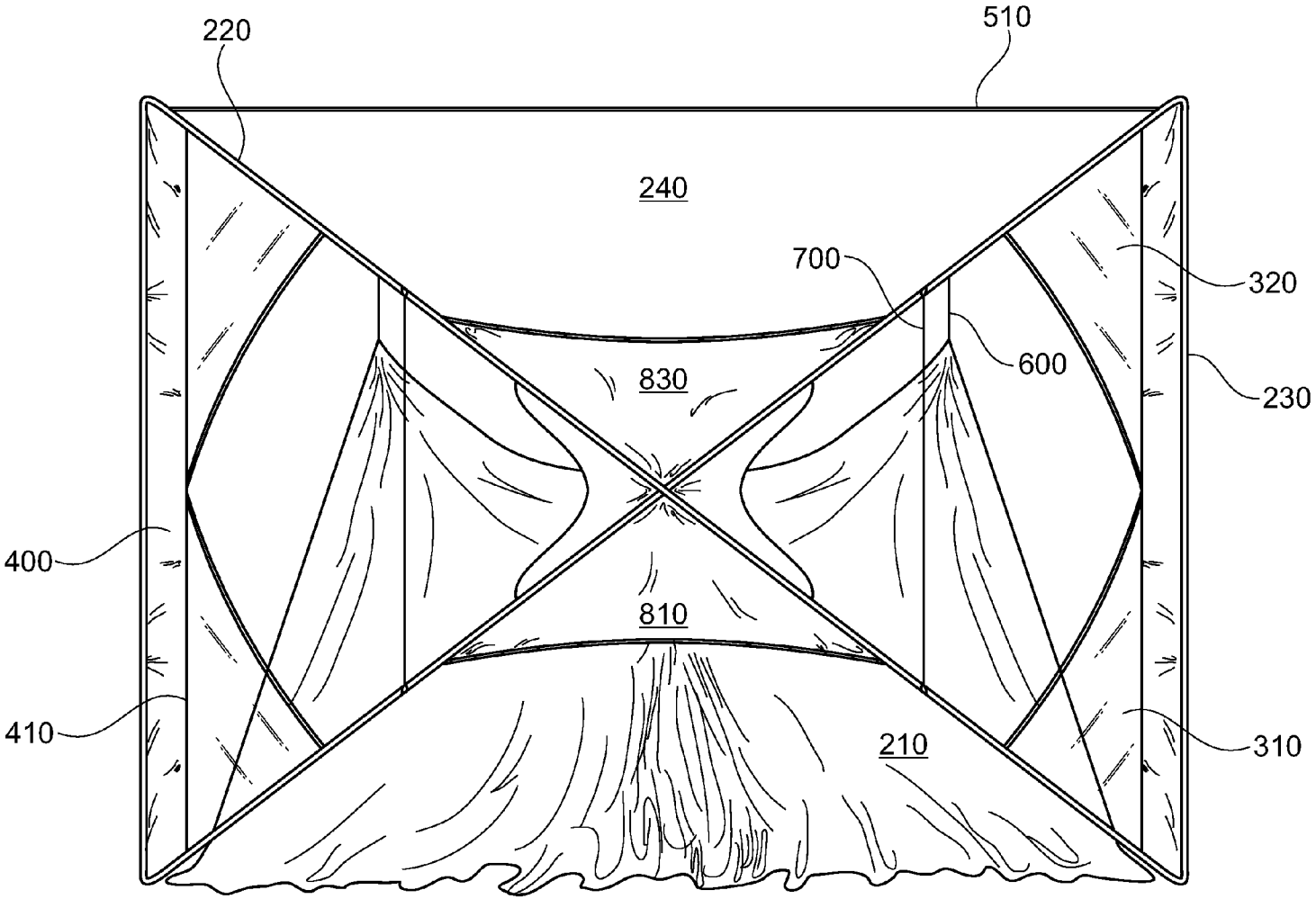
FIG. 7 depicts a top plan view of a disclosed system

FIG. 1 further depicts a top canopy system 800 comprising a front member 810, two lateral members 820 and a rear member 830, shown in FIG. 7.

FIG. 1 further depicts significant void areas which assist in ball return, ease of assembly, damping of impact, economy of construction and other advantages. The use of disclosed void areas is a far departure from the prior art sports nets, such as the sport net of FIG. 12. Two lateral voids 250 of the frame system are defined by front frame member 210, rear frame member 220, stabilizer cord 315 stabilizer cord 325 and upper lateral stabilizer cord 700. A rear void 240 of the frame system is defined by rear frame members 220, rear stabilizer cord 510, and rear member 830 of top canopy system. The rear member 830 of the top canopy system is shown in FIG. 7.

Figure 2:
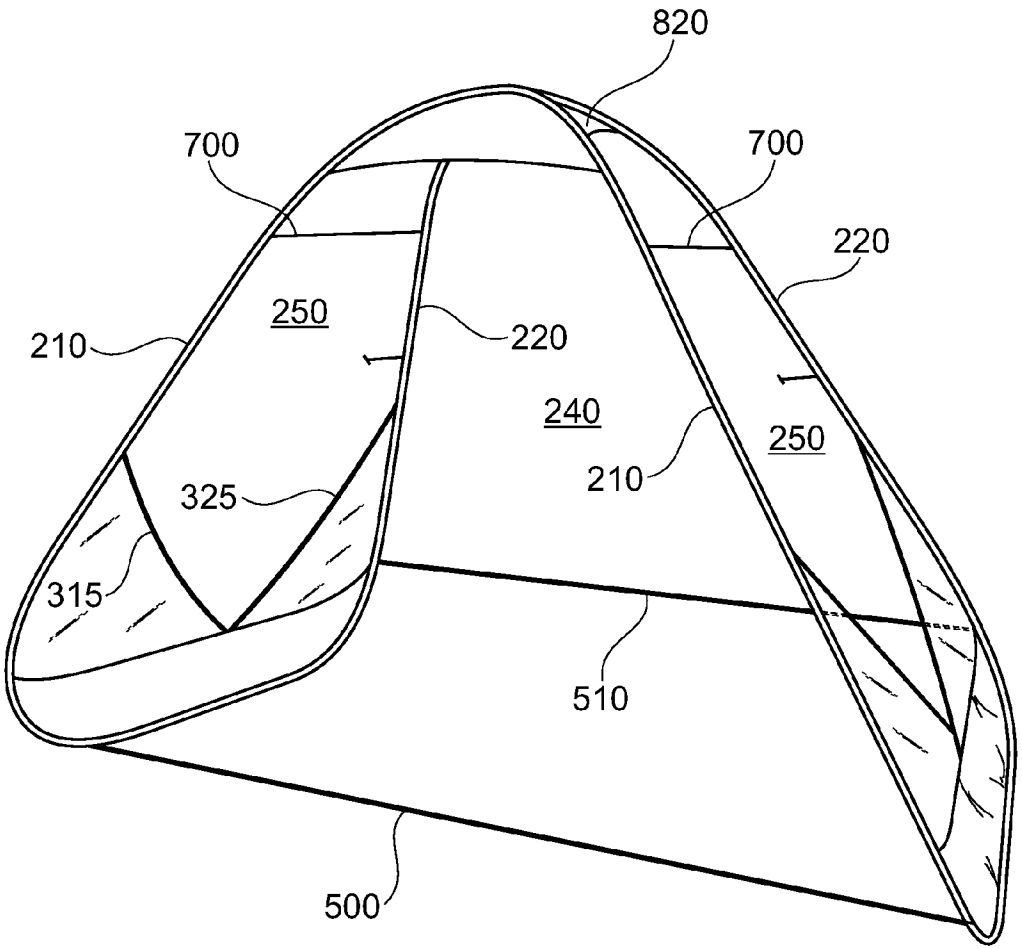
FIG. 2 depicts a front perspective view of a disclosed system without an inside net

FIG. 2 more clearly illustrates two lateral voids 250 of the frame system defined by front frame member 210, rear frame member 220, stabilizer cord 315 stabilizer cord 325 and upper lateral stabilizer cord 700. The two lateral voids may also have a top boundary defined by the lateral members 820 of the top cap assembly.

Figure 3:
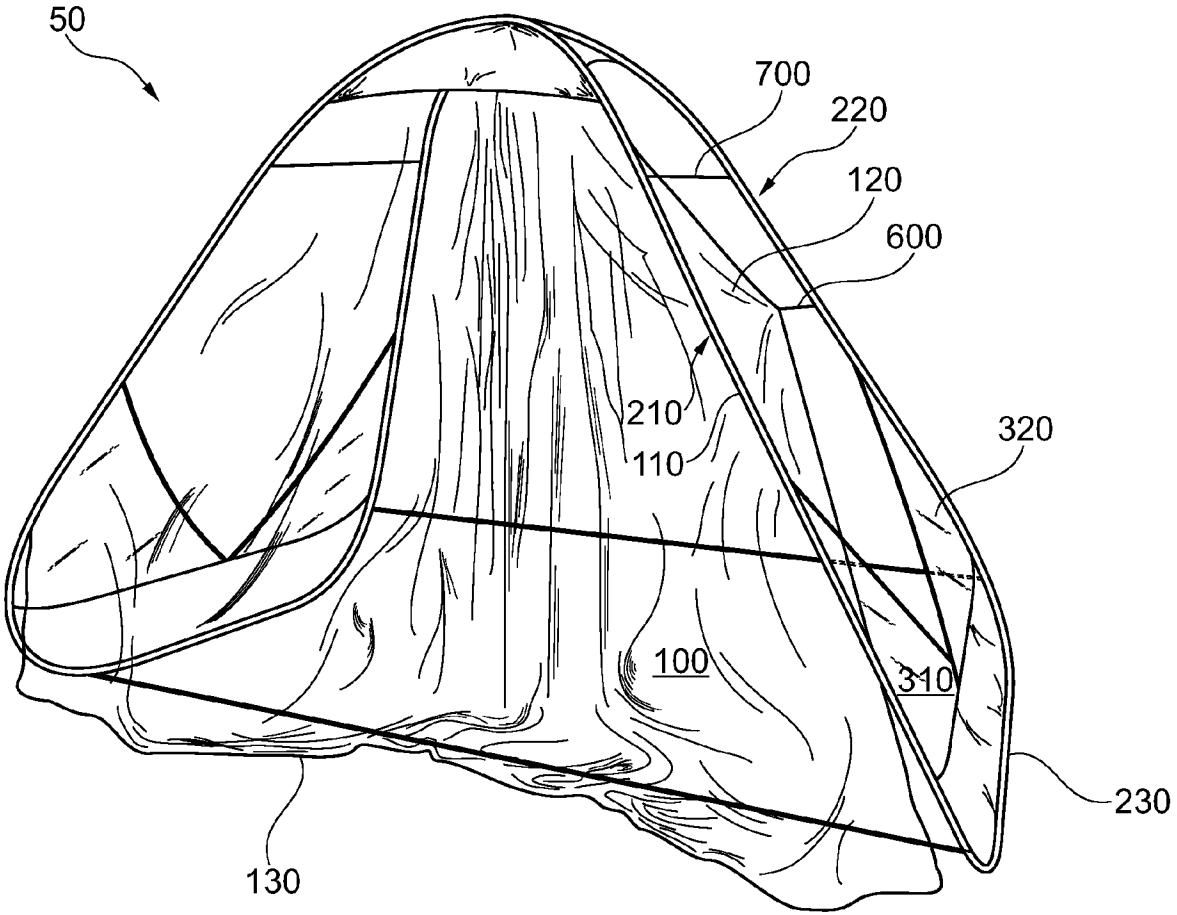
FIG. 3 depicts a front perspective view of a disclosed system

FIG. 3 depicts a system 50 in general comprising an inside net 100 in attachment to the front frame members at the lateral edges 110 of the inside net. A lower edge 130 of the inside net is shown upon the ground. Upper rear portions 120 of the inside net are shown in attachment to the elastic cords 600, with the elastic cords 600 attached to the rear frame members 220. A top portion of the inside net is attached to the top intersection or apex 270 of the front and rear frame members.

Figure 4:
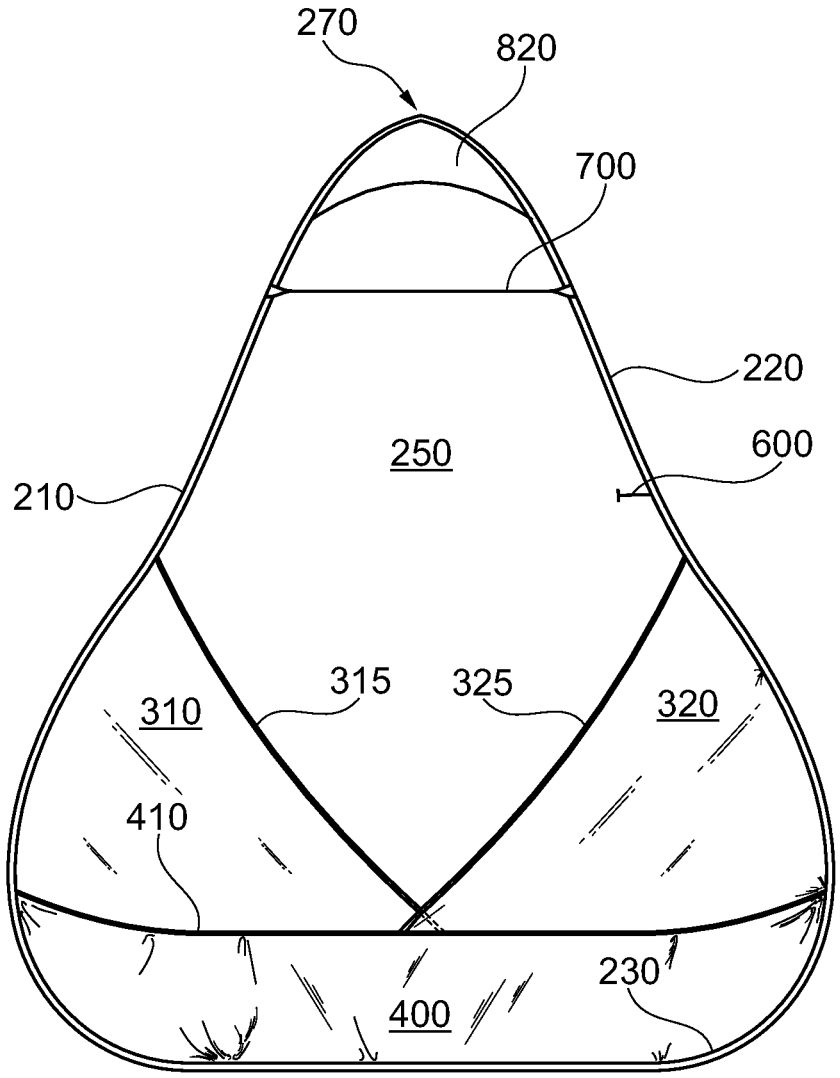
FIG. 4 depicts a side elevation view of a disclosed system without an inside net

FIG. 4 depicts an elevation view of a disclosed lateral section with the inside net removed for clarity of illustration. The front frame member 210 and rear frame member 220 are joined at the apex 270 just above the lateral member 820 of the top canopy system.

Figure 5:
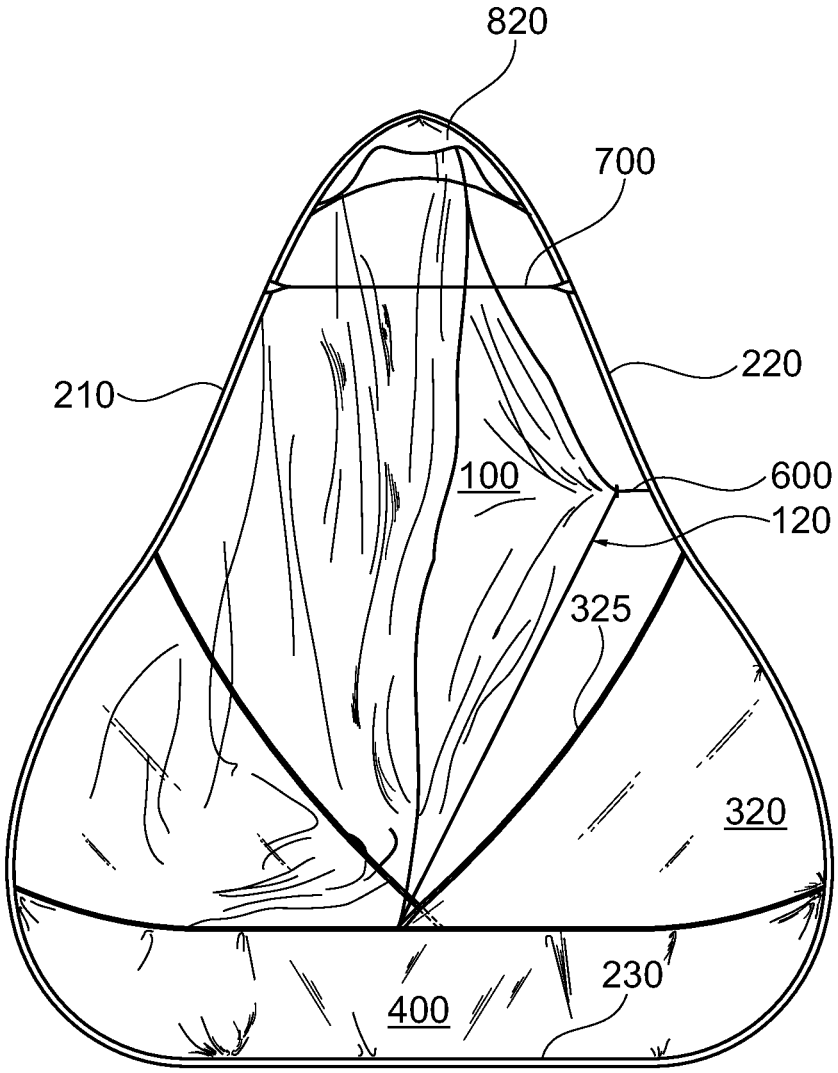
FIG. 5 depicts a side elevation view of a disclosed system

FIG. 5 depicts an elevation view of a disclosed lateral section with an upper rear portion 120 of the inside net attached to the elastic cord 600, the elastic cord 600 attached to the rear frame member 220. The artful use of the elastic cord 600 attached to the rear frame member and inside net help with the return of balls and other features.

Figure 6:
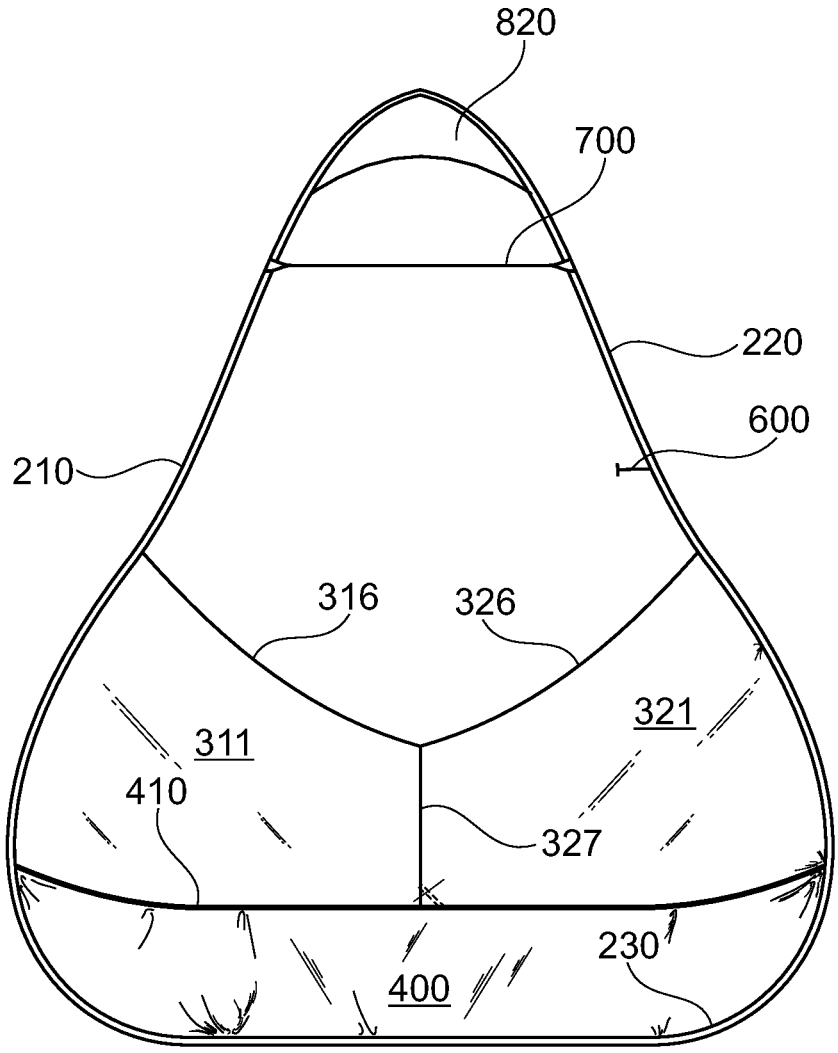
FIG. 6 depicts a side elevation view of a disclosed system with an alternative lateral embodiment

FIG. 6 depicts an alternative embodiment wherein an alternative front lateral stabilizer net 311 and rear lateral stabilizer net 321 are have upper portions 316 and 326 round in shape. Other shapes and configurations are contemplated and disclosed herein. An optional cord 327 or seam is shown in attachment with the alternative front 311 and rear 321 lateral stabilizer nets.

FIG. 7 depicts a top view of a disclosed system featuring a rear void 240 of the frame system defined by the rear member 830 of the top canopy system, two rear frame members 220 and the rear stabilizer cord 510.

Figure 8:
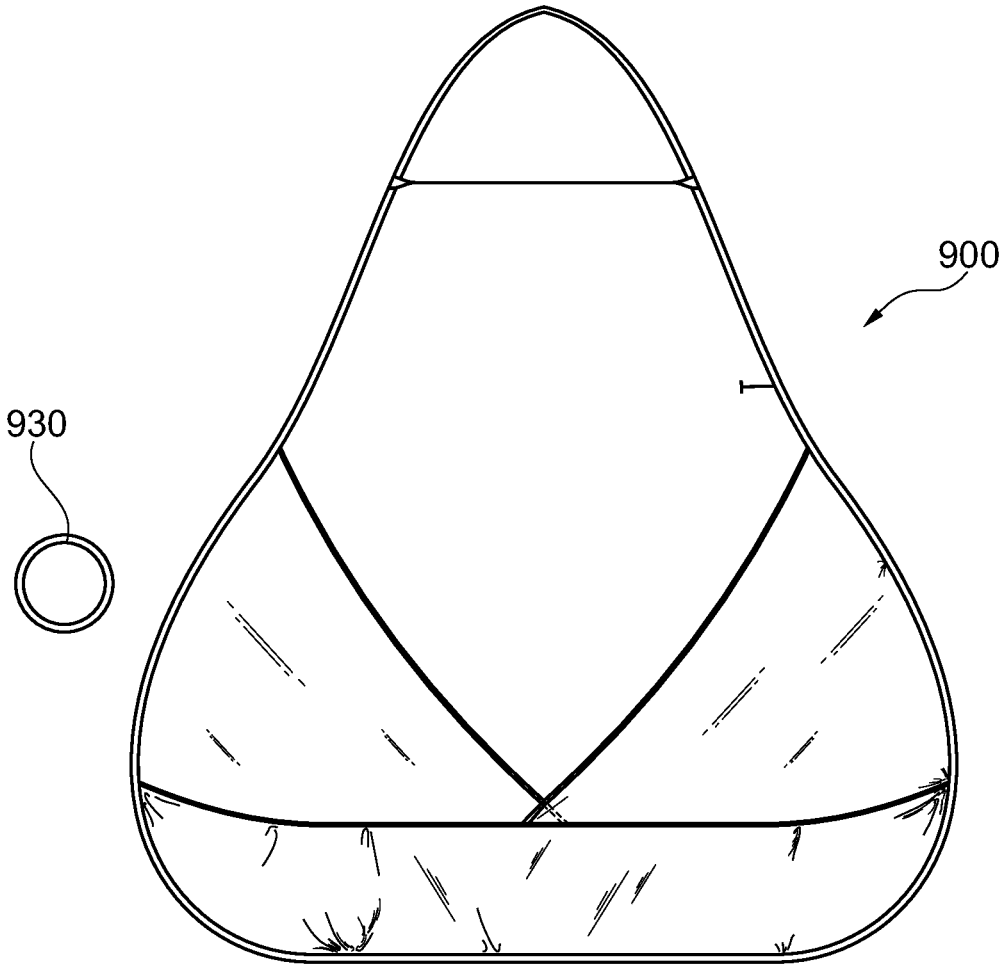
FIG. 8 depicts a disclosed system prior to impact

FIG. 8 depicts an elevation view of a disclosed system and a ball 930 or other projectile in flight toward the system. The system is shown in a neutral position 900 before impact.

Figure 9:
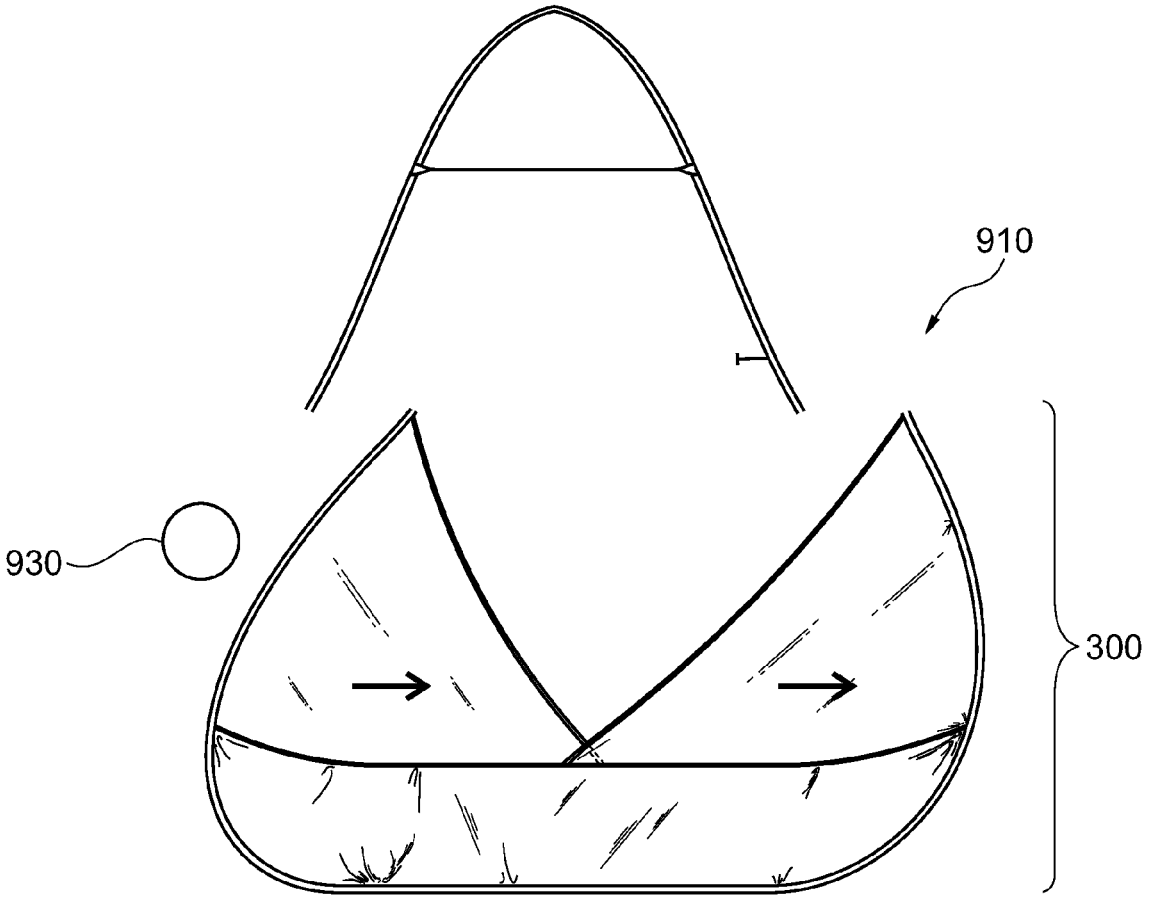
FIG. 9 depicts a disclosed system in a compressed state during impact

FIG. 9 depicts a disclosed system in compression or in an inward deformation 910 as a result of being struck by a ball 930 or other projectile. The lateral elastic net system 300 is shown flexed to the rear, storing kinetic energy absorbed from the projectile. The figure is not drawn to scale and the upper portions of the drawing are shown for a frame of reference only. The energy absorbed from the projectile may be stored within the frame system 200, the frame system comprising steel coils or other materials. While not shown, the entire frame system may distort or otherwise compress to absorb and store the kinetic energy of the projectile. The ball return systems or attributes are not limited to the lateral elastic net system 300.

Figure 10:
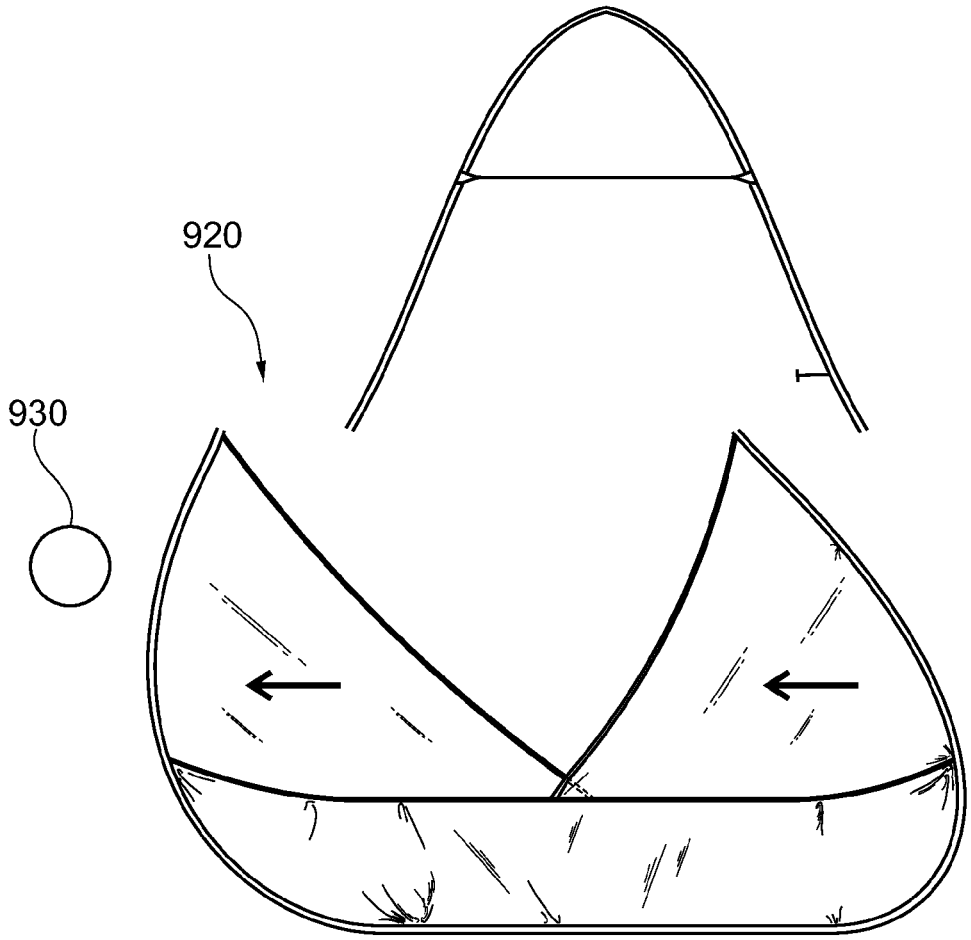
FIG. 10 depicts a disclosed system propelling a projectile after impact

FIG. 10 shows a ball return function wherein the projectile is propelled back to the origin by use of kinetic energy stored in the ball return system. The system is shown in a state of outward deformation 920 or expansion.

Figure 11:
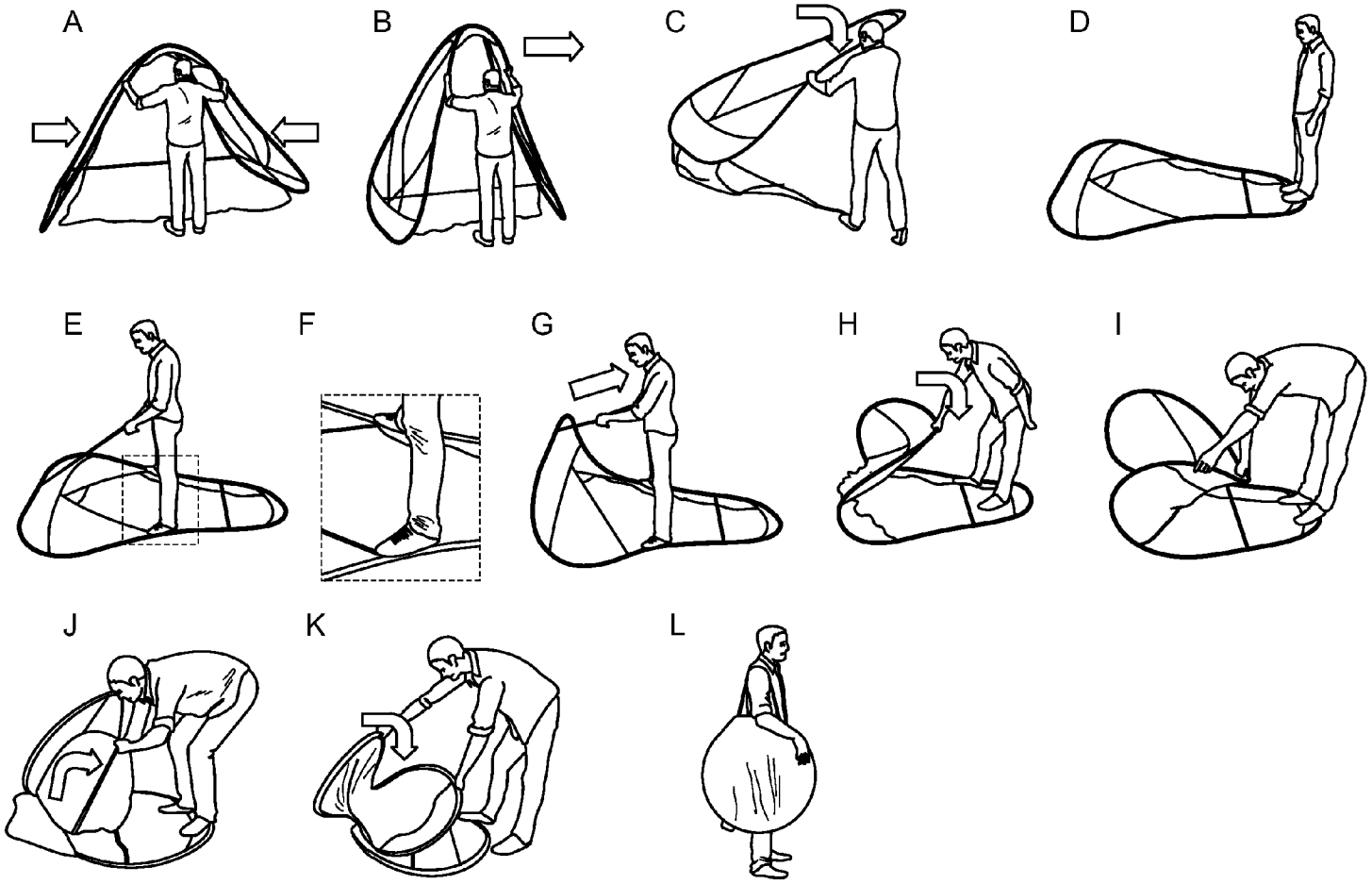
FIG. 11A-L depict various states of folding of a disclosed system

FIG. 11 depicts the folding of a disclosed system in views A to L.

Figure 12:
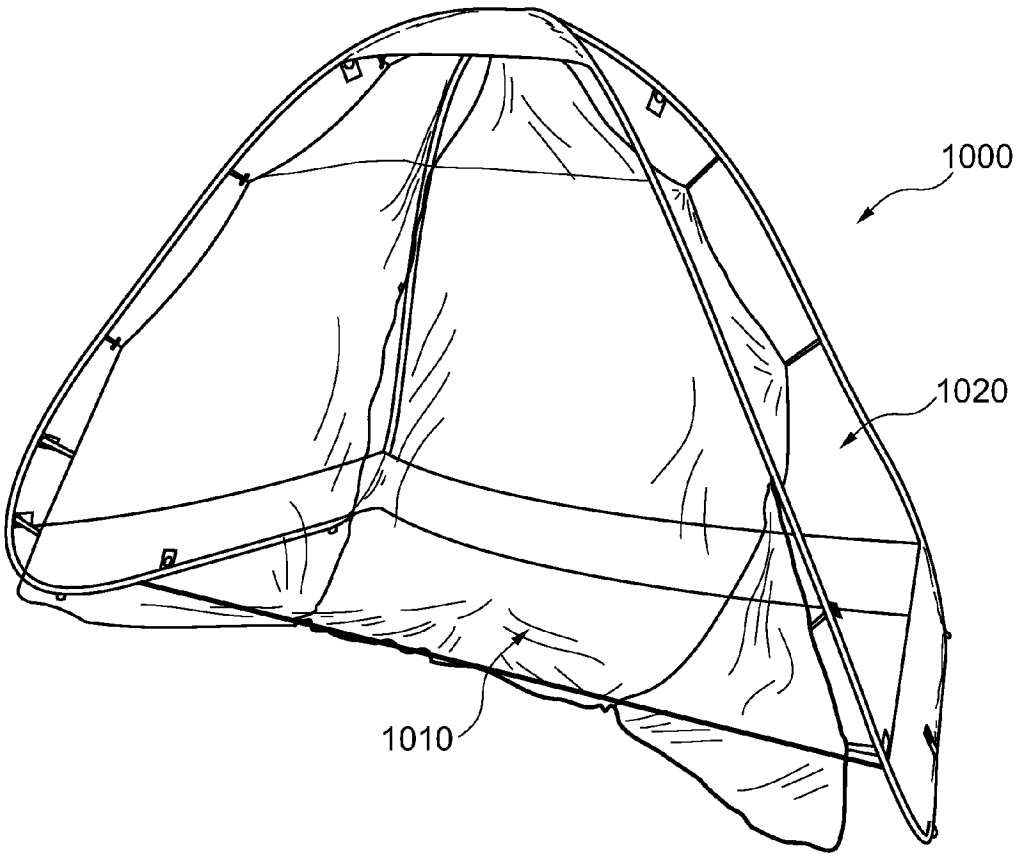
Fig. 12 Prior Art
FIG. 12 depicts a sport net of the prior art

FIG. 12 depicts a sport net system of the prior art having a floor system 1010 and a full lateral net system 1020. The prior art net systems use more material as compared to the presently disclosed systems. The prior art systems lack void systems and other useful attributes of the presently disclosed systems.

Figure 13:
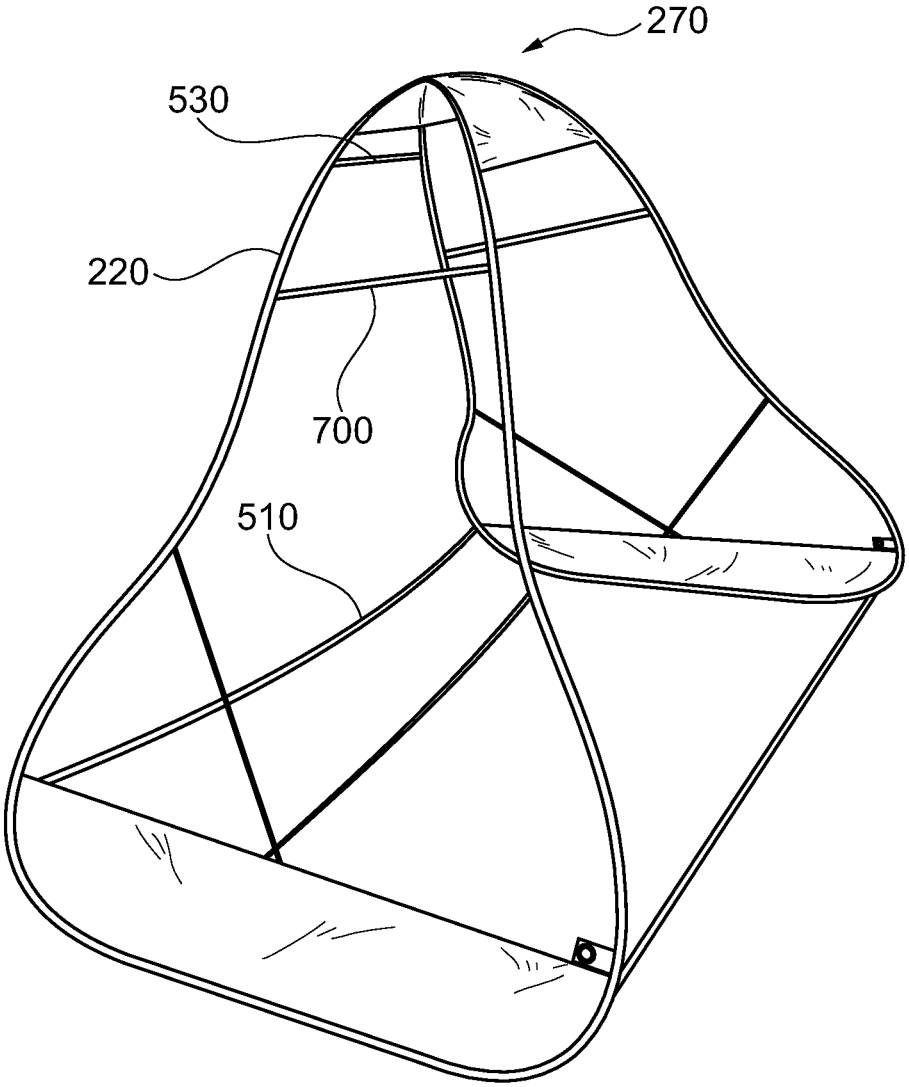
FIG. 13 depicts a disclosed system without an inside net

FIG. 13 depicts a system with the inside net removed. The rear features an upper rear stabilizer cord 530 attached to top portions of the rear frame members 220 near apex 270. In this configuration, a rear void 240 is defined by rear frame members 220, rear stabilizer cord 510 and upper rear stabilizer cord 530.

Figure 14:
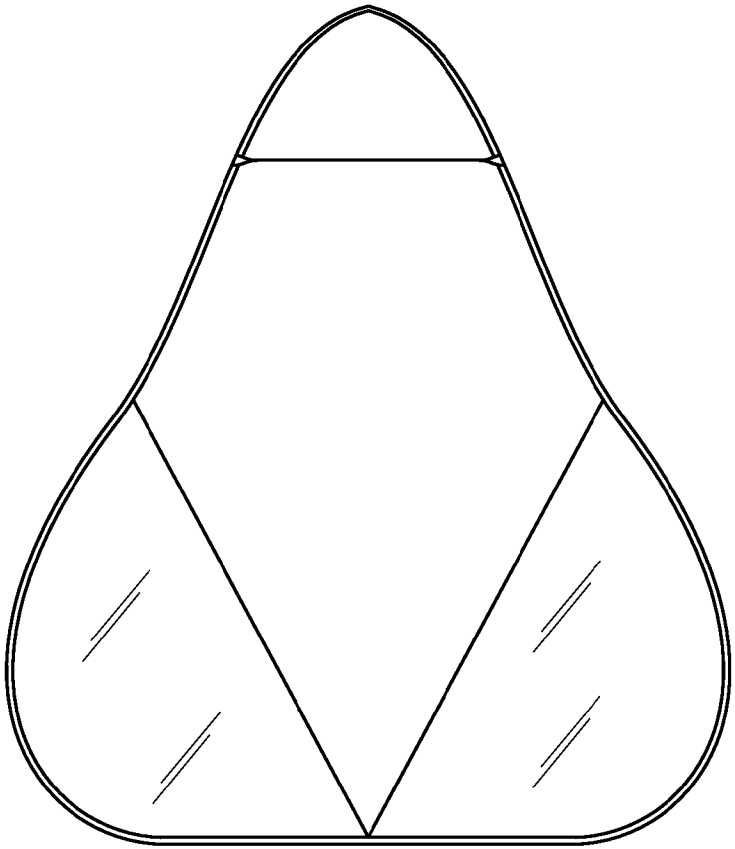
FIG. 14 depicts an alternative lateral feature embodiment

FIG. 14 depicts an alternative lateral configuration wherein the lateral nets are "V" in shape and the lower lateral support panel is absent.

Figure 15:
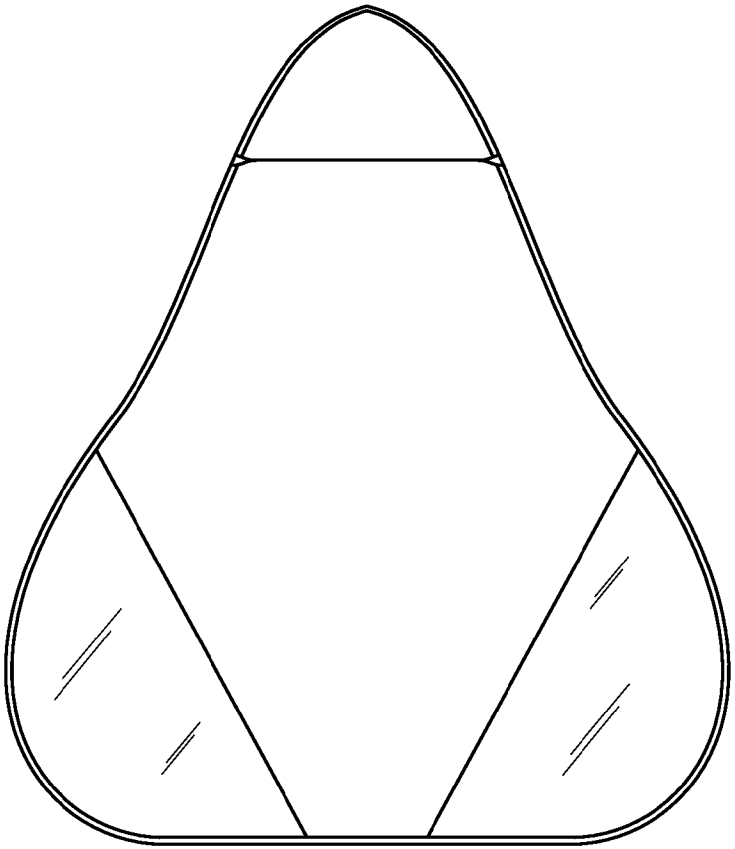
FIG. 15 depicts an alternative lateral feature embodiment

FIG. 15 depicts an alternative lateral configuration wherein the lateral nets are separated and the lower lateral support panel is absent.

In all configurations, the lower lateral support panel and lateral nets may be made of any type of fabric and may be elastic or non-elastic.

In all configurations all cords, straps, belts and other fasteners may be made of any type of fabric and may be elastic or non-elastic.

The disclosed embodiments include the use of non-elastic members and fabrics in place of components described as "elastic." Components may be fabricated of traditional textile materials in either elastic or non-elastic configurations. The inside net may be removed from frame members to facilitate economical repairs.

Items:

Disclosed components of the disclosed systems include, but are not limited to:

A sport net and ball return system, the system comprising:

a) a frame system 200, the frame system comprising one or more front frame members 210, one or more rear frame members 220, with the front and rear frame members in attachment to a lower lateral frame member 230 and at an upper apex 270;

b) the frame system attached to two lower lateral support panels 400, each lower lateral support panel in attachment to a lateral stabilizer cord 410, with each lower lateral stabilizer cord attached to lower sides of an elastic front lateral stabilizer net 310 and an elastic rear lateral stabilizer net 320, the elastic front stabilizer net further defined by a first stabilizer cord 315 and the elastic rear lateral stabilizer net further defined by a second stabilizer cord 325;

c) the front and rear frame members further secured together by two upper lateral stabilizer cords 700;

d) the upper apex attached to a top canopy system 800;

e) each lower lateral frame member having a rear side with the rear sides in attachment to a rear stabilizer cord 510;

f) each lower lateral frame member having a front side with the front sides in attachment to a front stabilizer cord 500; and g) an inside net 100 having lateral edges 110 attached to the front frame members, and the inside net having upper rear portions 120 attached to two or more elastic cords 600 the elastic cords attached to the rear frame members.

Item 2. The system of item 1 wherein the lower lateral support panel comprises a static non-elastic member.

Item 3. The system of item 1 wherein the lateral stabilizer cords comprise a static non-elastic member.

Item 4. The system of item 1 wherein the front stabilizer cord and the rear stabilizer cord comprise a static non-elastic member.

Item 5. The system of item 1 wherein the first stabilizer cords and second stabilizer cords of the front and rear elastic lateral stabilizer nets comprise a static non-elastic member.

Item 6. The system of item 1 wherein the top canopy system comprises a front member 810, two lateral members 820 and a rear member 830.

Item 7. The system of item 6 further comprising two lateral voids 250, the lateral voids defined by the front frame member, the rear frame member, the upper lateral stabilizer cord, the elastic front lateral stabilizer net and the elastic rear stabilizer net.

Item 8. The system of item 6 further comprising a rear void 240 defined by the rear stabilizer cord 510 and the rear frame members 220.

Item 9. The system of item 8 further comprising the rear void further defined by the rear member of the top canopy system.

Item 10. They system of item 9 wherein the rear stabilizer cord is attach to the rear frame members and ends of the lateral stabilizer cords.

What is claimed is:

1. A sport net and ball return system, the system comprising:

a) a frame system, the frame system comprising front frame members, and rear frame members, with the front and rear frame members in attachment to a lower lateral frame member and at an upper apex;

b) the frame system attached to two lower lateral support panels, each lower lateral support panel in attachment to a lateral stabilizer cord, with each lower lateral stabilizer cord attached to lower sides of an elastic front lateral stabilizer net and an elastic rear lateral stabilizer net, the elastic front stabilizer net further defined by a first stabilizer cord and the elastic rear lateral stabilizer net further defined by a second stabilizer cord;

c) the front and rear frame members further secured together by two upper lateral stabilizer cords;

d) the upper apex attached to a top canopy system;

e) each lower lateral frame member having a rear side with the rear sides in attachment to a rear stabilizer cord;

f) each lower lateral frame member having a front side with the front sides in attachment to a front stabilizer cord; and g) an inside net having lateral edges attached to the front frame members, and the inside net having upper rear portions attached to two or more elastic cords the elastic cords attached to the rear frame members.

2. The system of claim 1 wherein the lower lateral support panel comprises a static non-elastic member.

3. The system of claim 2 wherein the lateral stabilizer cords comprise a static non-elastic member.

4. The system of claim 1 wherein the front stabilizer cord and the rear stabilizer cord comprise a static non-elastic member.

5. The system of claim 1 wherein the first stabilizer cords and second stabilizer cords of the front and rear elastic lateral stabilizer nets comprise a static non-elastic member.

6. The system of claim 1 wherein the top canopy system comprises a front member, two lateral members and a rear member.

7. The system of claim 6 further comprising two lateral voids, the lateral voids defined by the front frame member, the rear frame member, the upper lateral stabilizer cord, the elastic front lateral stabilizer net and the elastic rear stabilizer net.

8. The system of claim 6 further comprising a rear void defined by the rear stabilizer cord and the rear frame members.

9. The system of claim 8 further comprising the rear void further defined by the rear member of the top canopy system.

10. The system of claim 9 wherein the rear stabilizer cord is attached to the rear frame members and ends of the lateral stabilizer cords.

11. The system of claim 1 wherein the front and rear stabilizer nets are made of solid fabric.

* * * * *